US010322781B1

(12) United States Patent
Haynes et al.

(10) Patent No.: US 10,322,781 B1
(45) Date of Patent: Jun. 18, 2019

(54) LIFE RAFT SYSTEM WITH REVERSIBLE CANOPY

(71) Applicant: GOODRICH CORPORATION, Charlotte, NC (US)

(72) Inventors: Timothy C Haynes, Prescott Valley, AZ (US); Michael A Luzader, Laveen, AZ (US)

(73) Assignee: GOODRICH CORPORATION, Charlotte, NC (US)

( * ) Notice: Subject to any disclaimer, the term of this patent is extended or adjusted under 35 U.S.C. 154(b) by 0 days.

(21) Appl. No.: 15/865,927

(22) Filed: Jan. 9, 2018

(51) Int. Cl.
*B63C 9/04* (2006.01)

(52) U.S. Cl.
CPC ..... *B63C 9/04* (2013.01); *B63C 2009/042* (2013.01); *B63C 2009/046* (2013.01)

(58) Field of Classification Search
CPC ..... B63C 9/04; B63C 2009/046; B63C 2009/042
USPC ..... 441/30
See application file for complete search history.

(56) References Cited

U.S. PATENT DOCUMENTS 4,678,443 A * 7/1987 Edwards ..... B63C 9/04 441/38
6,106,349 A * 8/2000 Motosko ..... B63C 9/155 441/129
6,554,669 B1 * 4/2003 Motosko ..... B63C 9/155 441/108
8,382,541 B1 * 2/2013 Campbell ..... B63C 9/04 114/349

* cited by examiner

*Primary Examiner* — Anthony D Wiest
(74) *Attorney, Agent, or Firm* — Snell & Wilmer, L.L.P.

(57) ABSTRACT

A life raft may include a base having a first side and a second side. The life raft may also include a first canopy support arm coupled proximate the base, a second canopy support arm coupled proximate the base, and a canopy coupled to the base. At least one of the first canopy support arm or the second canopy support arm may comprise a joint.

16 Claims, 7 Drawing Sheets

LIFE RAFT SYSTEM WITH REVERSIBLE CANOPY

FIELD

The present disclosure relates to aircraft evacuation assemblies, and more specifically to life rafts having a canopy.

BACKGROUND

In the event of an emergency water landing, aircraft typically have one or more life rafts that can be deployed to hold evacuated passengers. To protect passengers from the sun, rain, weather conditions, and other elements, life rafts include a canopy for shielding the passengers from the aforementioned conditions.

SUMMARY

According to various embodiments, the present disclosure provides a life raft comprising a base comprising a first side and a second side, a first canopy support arm coupled proximate with the base, a second canopy support arm coupled proximate with the base, and a canopy coupled to the base.

In various embodiments, at least one of the first canopy support arm or the second canopy support arm comprises a joint. In various embodiments, the joint comprises a base end and a support arm end. In various embodiments, the joint comprises at least one of opposed frustoconical portions, an excess material, or a strap. In various embodiments, the joint further comprises a first tapered portion having a first diameter, a second tapered portion having the first diameter, and an interface between the first tapered portion and the second tapered portion having a second diameter, wherein the second diameter is about ¾ of the first diameter. In various embodiments, the first canopy support arm and the second canopy support arm are configured to support the canopy and form a first chamber by rotating from an initial position proximate the base to an orthogonal position over the first side. In various embodiments, the first canopy support arm and the second canopy support arm are further configured to support the canopy and form a second chamber by rotating from an initial position proximate the base to an orthogonal position over the second side. In various embodiments, in response to the rotating from an initial position proximate the base to an upright position, a first return force is generated to return the first canopy support arm to the initial position and a second return force is generated to return the second canopy support arm to the initial position. In various embodiments, the first canopy support arm comprises a first tip and the second canopy support arm comprises a second tip, wherein the first canopy support arm is coupled to the second canopy support arm forming an arched structure over at least one of the first side or the second side, wherein the first tip overlaps the second tip, wherein the first return force opposes the second return force. In various embodiments, the canopy is configured to extend across the arched structure and the first side of the base to form the first chamber, wherein the arched structure extends over the first side, wherein the first chamber is defined between the first side of the base and the canopy. In various embodiments, the canopy is further configured to extend across the arched structure and the second side of the base to form the second chamber, wherein the arched structure extends over the second side, wherein the second chamber is defined between the second side of the base and the canopy. In various embodiments, the life raft is reversible such that: in response to the life raft being deployed with the second side obstructed and the arched structure extending over the first side, the first chamber functions as a passenger compartment; and in response to the life raft being deployed with the first side obstructed and the arched structure extending over the second side, the second chamber functions as a passenger compartment. In various embodiments, the first return force is between 5 and 20 lbs, wherein the second return force is between 5 and 20 lbs, and wherein an opposition between the first return force and the second return force stabilizes the arch structure. In various embodiments, the base comprises a first border tube circumscribing the first side of the base and a second border tube circumscribing the second side of the base. In various embodiments, the canopy is coupled to at least one of the first canopy support arm or the second canopy support arm.

In various embodiments, the present disclosure provides a life raft comprising a base comprising a first border tube and a second border tube, wherein the first border tube circumscribes a first side of the base and the second border tube circumscribes a second side of the base, an arch structure extending over at least one of the first side of the base or the second side of the base, and a canopy coupled to the arch structure and configured to extend across the at least one of the first side of the base or the second side of the base, wherein the canopy configured to extend across the first side of the base forms a first chamber defined between the first side of the base, the arch structure extending over the first side of the base and the canopy, and wherein the canopy configured to extend across the second side of the base forms a second chamber defined between the second side of the base, the arch structure extending over the second side of the base and the canopy. In various embodiments, the arched structure comprises a canopy support arm comprising a joint configured to enable the first chamber or the second chamber to function as a passenger compartment depending upon the orientation of the life raft with respect to a body of water.

Also disclosed herein, according to various embodiments, is a method of using a life raft comprising a reversible canopy system comprising inflating the life raft, inflating a first canopy support arm and a second canopy support arm in response to inflating the life raft, rotating the first canopy support arm and the second canopy support arm relatively orthogonal with respect to a base of the life raft and, in response to the rotating the first canopy support arm and the second canopy support arm relatively orthogonal with respect to the base of the life raft, generating a first return force and a second return force, coupling the first canopy support arm and the second canopy support arm and, in response, forming an arched structure over a side of the base of the life raft disposed above an obstruction wherein a tip of the first canopy support arm overlaps a tip of the second canopy support arm, wherein the first return force and the second return force are in opposition, and configuring a chamber defined between a canopy over the arched structure and the side of the base of the life raft disposed above the obstruction to function as a passenger compartment. The method may further include at least partially opening the passenger compartment for passengers to embark. The method may further include positioning the first canopy support arm and the second canopy support arm are proximate the base in response to inflating the life raft.

The forgoing features and elements may be combined in various combinations without exclusivity, unless expressly indicated herein otherwise. These features and elements as well as the operation of the disclosed embodiments will become more apparent in light of the following description and accompanying drawings.

Figure 1:
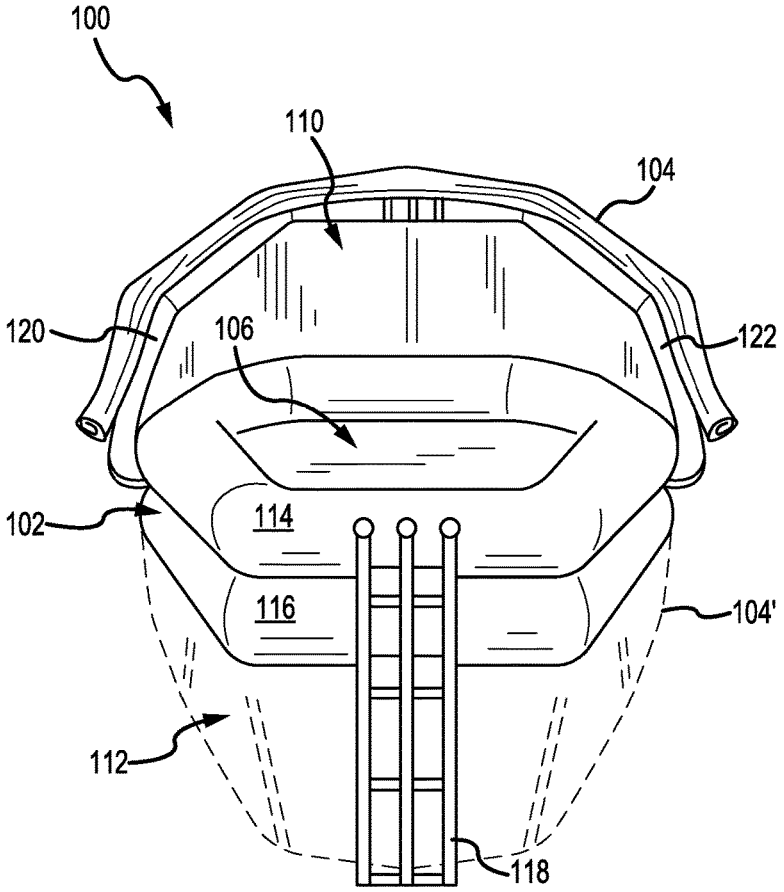
FIG. 1 is a perspective view of a life raft comprising a reversible canopy system at least partially open to allow passengers to embark, in accordance with various embodiments.

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the disclosures, it should be understood that other embodiments may be realized and that logical changes and adaptations in design and construction may be made in accordance with this disclosure and the teachings herein. Thus, the detailed description herein is presented for purposes of illustration only and not of limitation. Throughout the present disclosure, like reference numbers denote like elements. Accordingly, elements with like element numbering may be shown in the figures but may not necessarily be repeated herein for the sake of clarity.

In the event of an emergency water landing, aircraft typically have one or more life rafts that can be deployed to hold evacuated passengers. To protect passengers from the sun, rain, weather conditions, and other elements, life rafts include a canopy for shielding the passengers from the aforementioned conditions. Life rafts may deploy in any orientation and therefore may employ a reversible canopy system comprising two sets of canopy support tubes (top side and bottom side sets) and a separate canopy to cover each set of canopy support tubes in order to cover both a top side and a bottom side of the life raft. Disclosed herein, according to various embodiments, is a life raft that includes a reversible canopy assembly and canopy support tubes (canopy support arms) configured to provide protection to passengers irrespective of the orientation of the life raft at the time of deployment. Said differently, the life raft provided herein is deployed without a second set of canopy support tubes, thus tending to decrease the complexity of the life raft, tending to decrease the weight of the life raft, and/or tending to decrease the cost of the life raft, according to various embodiments.

In various embodiments, and with reference to FIG. 1, life raft 100 is provided. The life raft 100 generally includes a base 102 and a canopy 104 according to various embodiments. The base 102 has a first side 106 and a second side 108 opposite the first side 106. The canopy 104 is coupled to the base 102 and is configured to extend across at least one of the first side 106 or the second side 108 of the base 102 to form a first chamber 110 defined between the first side 106 of the base 102 and the canopy 104, according to various embodiments. A similar arrangement may exist on the opposite side of the life raft 100. That is, the canopy 104 may be coupled to the base 102 and may be configured to extend across the second side 108 of the base 102 to form a second chamber 112 defined between the second side 108 of the base 102 and the canopy 104 (position 104' as illustrated by dashed lines). In this regard, canopy 104 may be deployed over the first side 106 when the second side 108 is facing an obstruction (such as, for example, a body of water) and in like regard canopy 104 may be deployed over second side 108 when first side 106 is facing an obstruction.

In various embodiments, the first side 106 of the base 102 of the life raft 100 may be a top surface of the life raft 100 upon which passengers are supported in response to the life raft 100 being deployed in water. That is, the base 102 of the life raft 100 may be inflatable and may thus be configured to float on water. The life raft 100 may include one or more ladders 118 that facilitate passenger embarking. The second side 108 of the base 102 of the life raft 100 may be a bottom surface of the life raft 100 that faces the water. In various embodiments, the base 102 may include a first border tube 114 and a second border tube 116. The first and second border tubes 114, 116 may provide buoyancy to the life raft 100 and may be mounted opposite each other with respect to base 102. Said differently, first border tube 114 is mounted relatively above base 102 with second border tube 116 relatively below base 102 when second border tube 116 is disposed proximate a body of water. The first and second border tubes 114, 116 may provide a degree of buoyancy redundancy in that each border tube may be independent capable of supporting the weight of the life raft 100 when filled with passengers. The first border tube 114 may circumscribe the first side 106 of the base 102 and the second border tube 116 may circumscribe the second side 108 of the base 102. In various embodiments, base 102 may lie between first border tube 114 and second border tube 116.

The canopy 104, according to various embodiments, is a top canopy that is configured to extend above the first side 106 of the base 102 of the life raft 100 to function as a protective covering that shields passengers from sun, rain, weather conditions, and other elements. Canopy 104 is supported by a first canopy support arm 120 and a second canopy support arm 122 each extending from at least one of the base 102, the first border tube 114, or the second border tube 116 over the first side 106. In various embodiments, canopy 104 may be coupled to at least one of the first canopy support arm 120 or the second canopy support arm 122. In various embodiments, and with brief additional reference to FIG. 4, canopy 104 may be configured as a bottom canopy extending below (wherein the terms "bottom" and "below" refer to positions relative to the life raft in use as a flotation device in water) the life raft 100 by extending the first canopy support arm 120 and the second canopy support arm 122 over the second side 108 to positions 120' and 122' and coupling the canopy 104 to the first canopy support arm 120 and the second canopy support arm 122 in position 104' as illustrated by dashed lines. In this regard, the canopy 104, the first canopy support arm 120, and the second canopy support arm 122 of the life raft 100 enable the life raft 100 to be reversibly deployed (i.e., the life raft 100 may be reversible). That is, the canopy 104 and the corresponding first chamber 110 or second chamber 112 may function as a passenger protecting top covering depending on the orientation of the life raft 100 when inflated and deployed into a body of water (i.e. whether first side 106 of second side 108 faces the water). The reversible configuration of life raft 100 and the canopy support arms are described in greater detail below with reference to FIG. 2 through FIG. 4.

Figure 2:
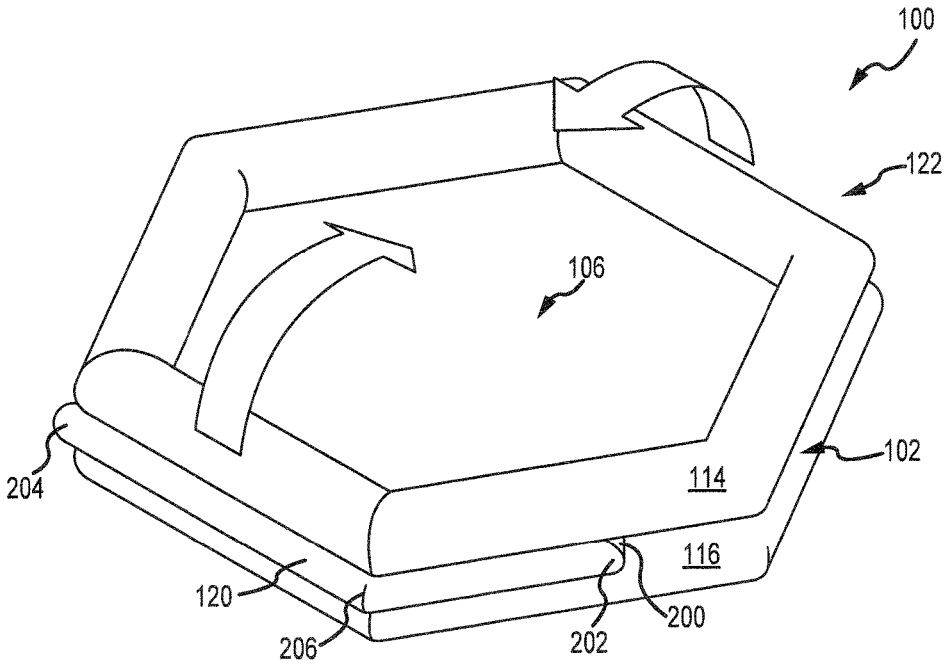
FIG. 2 illustrates a life raft comprising a reversible canopy system, in accordance with various embodiments.

In various embodiments, and with reference to FIG. 2, life raft 100 is shown, with various elements omitted for clarity and with first side 106 facing relatively 'up' and second side 108 facing relatively 'down' (i.e. proximate a body of water). First canopy support arm 120 is in an initial position proximate base 102 and second canopy support arm 122 is similarly situated opposite first canopy support arm 120 but is obscured by first border tube 114 and second border tube 116. First canopy support arm 120 extends from joint 200 at a first end 202 toward a tip 204. In various embodiments, joint 200 is coupled to base 102 and first canopy support arm 120 extends about the circumference of base 102 and comprises one or more bends 206 tending to allow the first canopy support arm 120 to conform to the contours of first border tube 114 and second border tube 116. In various embodiments, second canopy support arm 122 comprises similar features as first canopy support arm 120. In various embodiments, first canopy support arm 120 and second canopy support arm 122 may simultaneously inflate/deploy with the base 102 or may deploy in response to inflation of at least one the first border tube 114 or the second border tube 116. In various embodiments, first canopy support arm 120 and second canopy support arm 122 are configured to support canopy 104 and form the first chamber 110 by rotating the first canopy support arm 120 and the second canopy support arm 122 'upward' (along the black arrows to a position relatively orthogonal to base 102) relative to base 102 over the first side 106. In response to the rotation, first canopy support arm 120 bends about joint 200 as described in FIG. 3 toward a position relatively perpendicular to base 102.

Figure 3:
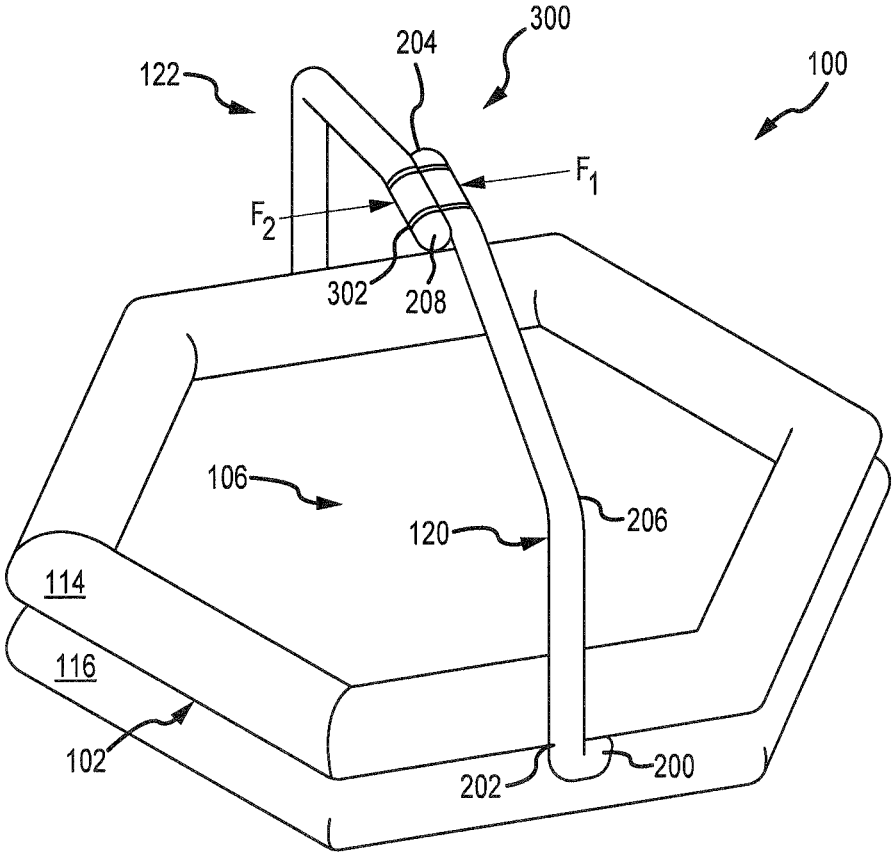
FIG. 3 illustrates a life raft comprising a reversible canopy system, in accordance with various embodiments.

In various embodiments and with additional reference to FIG. 3, life raft 100 is shown, with various elements omitted for clarity and with first side 106 facing relatively 'up' and second side 108 facing relatively 'down' (i.e. proximate a body of water). First canopy support arm 120 and second canopy support arm 122 are configured to support canopy 104 and form the first chamber 110. The first canopy support arm 120 and the second canopy support arm 122 are rotated relatively 'upward' (i.e. away from base 102 and toward first side 106) and erected over the first side 106 with tip 204 (i.e., a first tip) of first canopy support arm 120 and a tip 208 (i.e., a second tip) of second canopy support arm 122 overlapping to form arched structure 300. In various embodiments and in response to the rotation of first canopy support arm 120 from its initial position proximate base 102, a return force $F_1$ is generated tending to return first canopy support arm 120 to its initial position proximate base 102. In various embodiments, in response to the rotation of second canopy support arm 122 from its initial position proximate base 102 to an upright position, a return force $F_2$ is generated tending to return second canopy support arm 122 to its initial position proximate base 102. In various embodiments, arched structure 300 comprises a coupling 302 configured to overlap tip 204 of first canopy support arm 120 and tip 208 of second canopy support arm 122 such that return force $F_1$ opposes return force $F_2$ tending thereby to increase the stability of arched structure 300. Stated another way, coupling 302 is configured overlap the first tip and the second tip such that the first return force opposes the second return force.

In various embodiments, the return force F1 and return force F2 may be a function of an internal pressure of a canopy support arm. In various embodiments, an internal pressure of a canopy support arm may be between 1.0 psi [6.9 kPa] and 5.0 psi [34.5 kPa], or may be between 2.0 psi [13.8 kPa] and 4.0 psi [27.6 kPa], or may be between 3.0 psi [20.7 kPa] and 3.5 psi [24.1 kPa]. In various embodiments a return force may be between 5 lbs [22 N] and 20 lbs [89 N], or may be between 7 lbs [31 N] and 17 lbs [76 N], or may be between 10 lbs [45 N] and 15 lbs [67 N].

Figure 4:
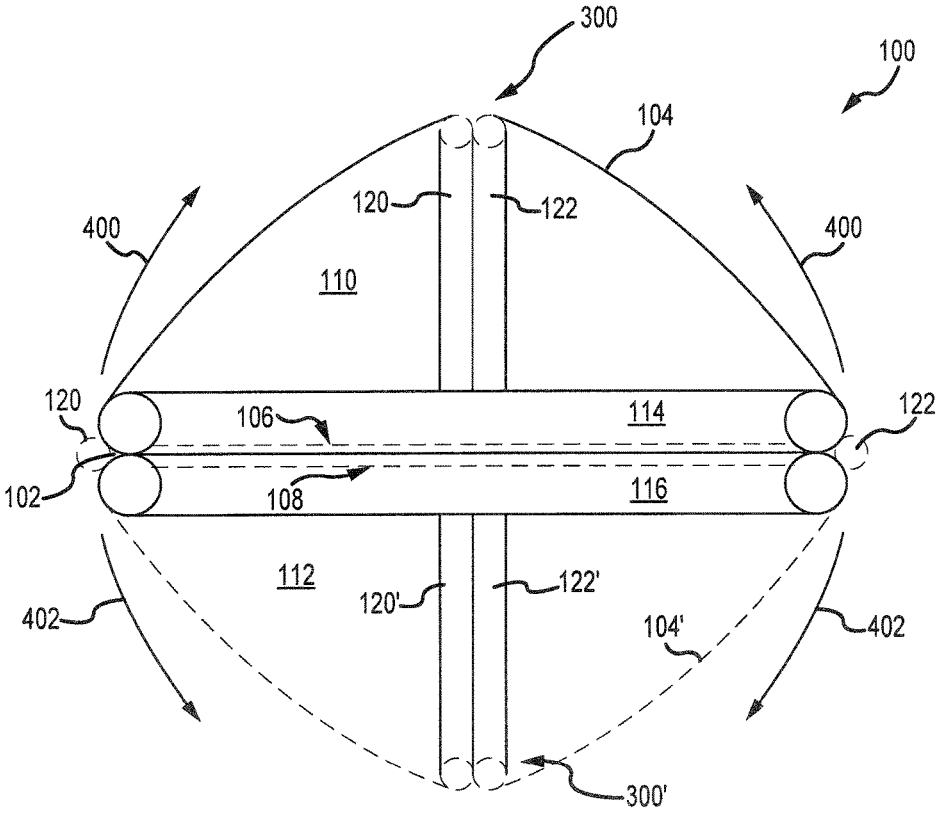
FIG. 4 illustrates a life raft comprising a reversible canopy system, in accordance with various embodiments.

In various embodiments and with additional reference to FIG. 4, life raft 100 is shown in cross section where the plane of arched structure 300 transects the plane of the page. In various embodiments, arched structure 300 comprises the first canopy support arm 120 and the second canopy support arm 122, wherein the first canopy support arm 120 and the second canopy support arm 122 have been rotated (along path of arrows 400) from their initial position proximate base 102 toward an orthogonal position relatively perpendicular to base 102. Arched structure 300 extends over first side 106 and may be coupled to canopy 104 to provide structural support for first chamber 110. In various embodiments, arched structure 300' comprises the first canopy support arm 120 and the second canopy support arm 122, wherein the first canopy support arm 120 and the second canopy support arm 122 have been rotated (along path of arrows 402) from their initial position proximate base 102 toward an orthogonal position (positions 120' and 122') relatively perpendicular to base 102. Arched structure 300' extends over second side 108 and may be coupled to canopy 104 (position 104') to provide structural support for second chamber 112. In various embodiments, one or more arched structures such as arched structure 300 may be formed by two or more canopy support arms such as first canopy support arm 120.

Figure 5:
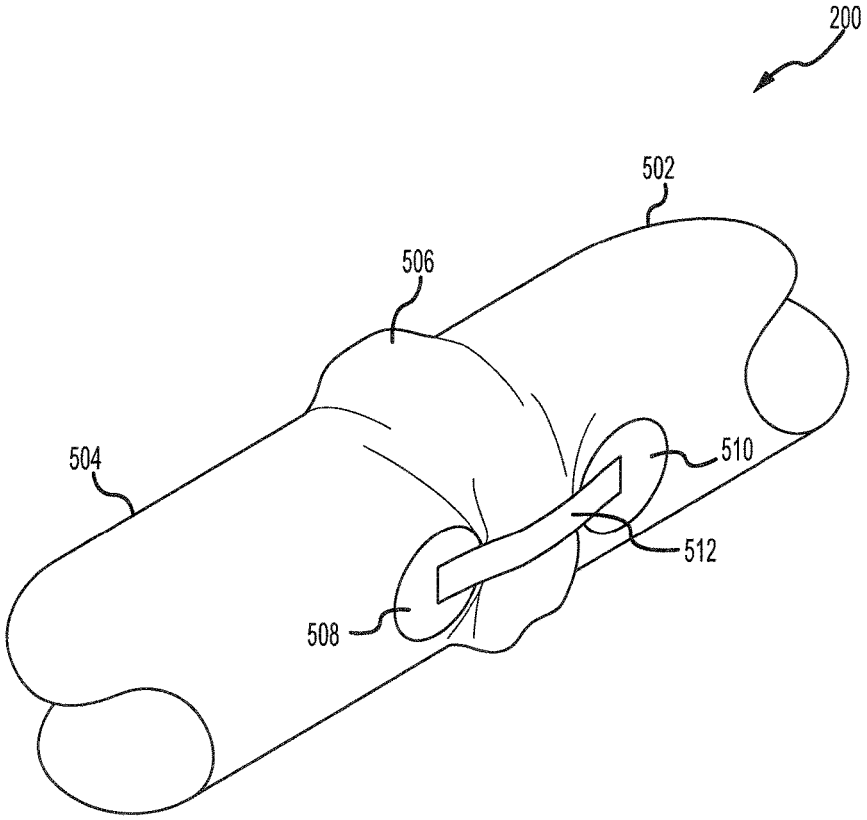
FIG. 5 illustrates a joint of a life raft comprising a reversible canopy system, in accordance with various embodiments

In various embodiments and with reference to FIG. 5, joint 200 of first canopy support arm 120 of life raft 100 is shown. Joint 200 comprises a base end 502 and a support arm end 504 linked by excess material 506. In various embodiments, the joint is reinforced by one or more sets of patches (patch 508 and patch 510) coupled to a strap 512. In various embodiments, strap 512 may be sewn at one end to patch 508 and at an opposite end to patch 510 and patch 508. In various embodiments, patch 508 may be bonded to support arm end 504 with strap 512 laid across excess material 506 and patch 510 bonded to base end 502. In this regard, joint 200 may be reinforced by strap 512 and enabled to flex at excess material 506 when first canopy support arm 120 is deployed. In various embodiments, base end 502 may be coupled proximate base 102 of life raft 100 and support arm end 507 may be coupled proximate first end 202 of first canopy support arm. In various embodiments, base end 502 may comprise a one way valve in fluid communication with at least one of the first border tube 114 or the second border tube 116. In various embodiments, second canopy support arm 122 may comprise a joint such as joint 200.

Figure 6:
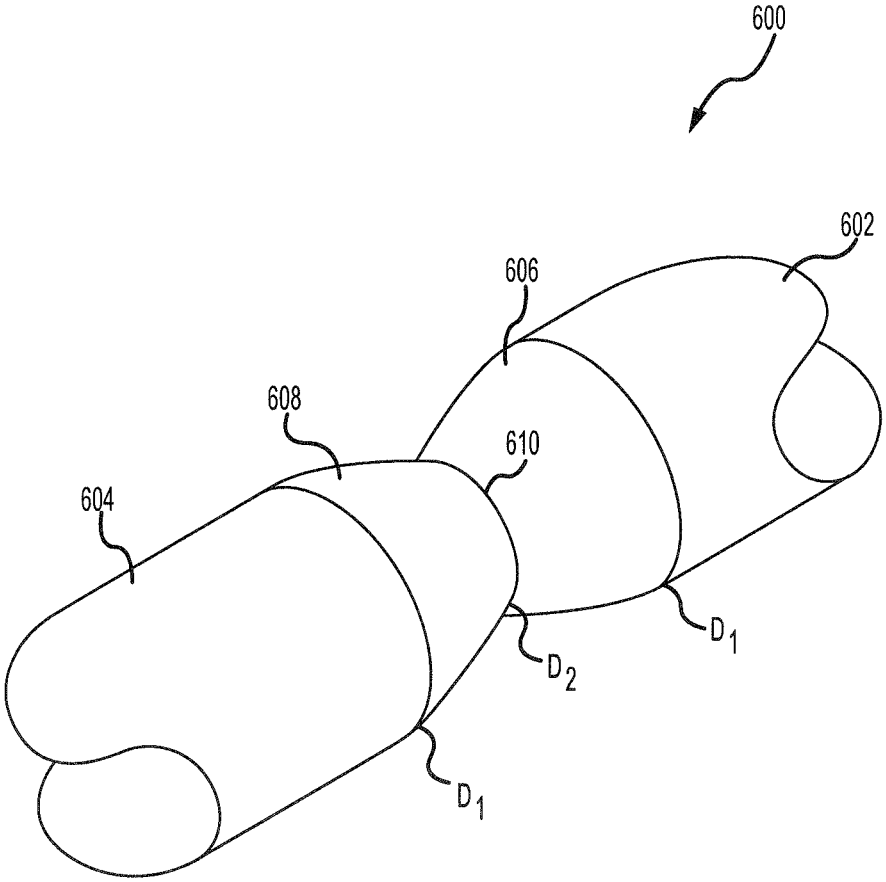
FIG. 6 illustrates a joint of a life raft comprising a reversible canopy system.

In various embodiments and with reference to FIG. 6, a joint 600 is shown. Joint 600 may comprises features, geometries, construction, manufacturing techniques, and/or internal components similar to joint 200. Joint 600 comprises base end 602 and a support arm end 604 linked by a pair of opposed frustoconical portions, i.e. a first tapered portion 606 and second tapered portion 608. First tapered portion 606 and second tapered portion 608 taper from a first diameter $D_1$ toward a second diameter D2 at the interface 610. In various embodiments, $D_2$ is about three fourths (¾) of $D_1$ where about in this context means±⅛$D_1$. In this regard, joint 600 may be enabled to flex at interface 610 with the first tapered portion 606 and the second tapered portion 608 tending to reduce interference between the base end 602 and the support arm end 604. In various embodiments, a canopy support arm, such as first canopy support arm 120 or second canopy support arm 122, may comprise a joint 600. In various embodiments, base end 602 may comprise a one way valve in fluid communication with a border tube such as border tube 114.

Figure 7:
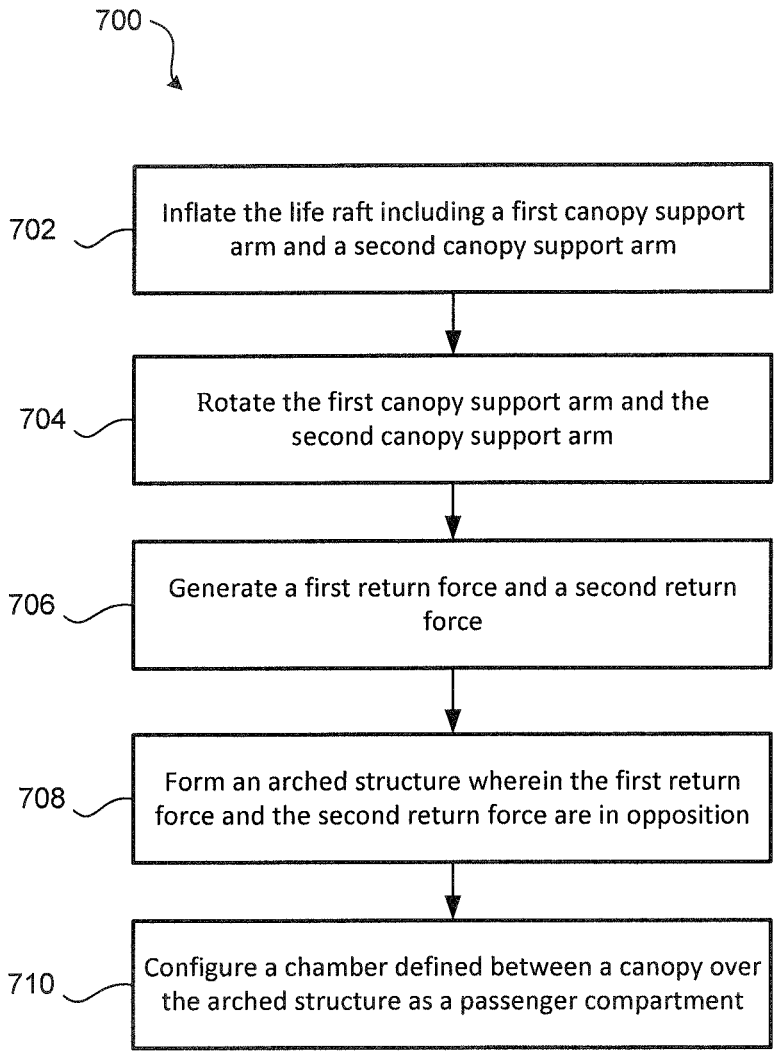
FIG. 7 is a schematic flow chart diagram of a method of using a life raft comprising a reversible canopy system, in accordance with various embodiments.

In various embodiments, and with reference to FIG. 7, a method 700 of using the life raft 100 is provided. The method 700 may include inflating the life raft 100, the first canopy support arm 120, and the second canopy support arm 122 at step 702, deploying the life raft 100 (e.g., onto water) and rotating the first canopy support arm 120 and the second canopy support arm 122 relatively upward with respect to the water at step 704. The method may further include generating first return force $F_1$ and second return force $F_2$ in response to the rotating the first canopy support arm 120 and the second canopy support arm 122 relatively upward (step 706). The method may further include coupling the first canopy support arm 120 and the second canopy support arm 122 and, in response, forming an arched structure 300 over a side of a base of the life raft 100 disposed above the water wherein a tip 204 of the first canopy support arm 120 overlaps a tip 208 of the second canopy support arm 122, wherein the first return force and the second return force are in opposition (step 708). The method may further include configuring a chamber such as first chamber 110 defined between a canopy such as canopy 104 over the arched structure 300 and the side of the base of the life raft disposed above the water to function as a passenger compartment (step 710). The method 700 may further include at least partially opening the passenger compartment for passengers to embark. In various embodiments, in response to deployment of the life raft 100 in water at step 704, the first canopy support arm 120 and the second canopy support arm 122 may be positioned proximate the base.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure.

The scope of the disclosure is accordingly to be limited by nothing other than the appended claims, in which reference to an element in the singular is not intended to mean "one and only one" unless explicitly so stated, but rather "one or more." It is to be understood that unless specifically stated otherwise, references to "a," "an," and/or "the" may include one or more than one and that reference to an item in the singular may also include the item in the plural. All ranges and ratio limits disclosed herein may be combined.

Moreover, where a phrase similar to "at least one of A, B, and C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

The steps recited in any of the method or process descriptions may be executed in any order and are not necessarily limited to the order presented. Furthermore, any reference to singular includes plural embodiments, and any reference to more than one component or step may include a singular embodiment or step. Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

Any reference to attached, fixed, connected or the like may include permanent, removable, temporary, partial, full and/or any other possible attachment option. Additionally, any reference to without contact (or similar phrases) may also include reduced contact or minimal contact. Surface shading lines may be used throughout the figures to denote different parts or areas but not necessarily to denote the same or different materials. In some cases, reference coordinates may be specific to each figure.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A life raft comprising:

a base comprising a first side and a second side;

a first canopy support arm coupled proximate with the base;

a second canopy support arm coupled proximate with the base; and a canopy coupled to the base, wherein at least one of the first canopy support arm or the second canopy support arm comprises a joint, wherein the first canopy support arm and the second canopy support arm are configured to support the canopy and form a first chamber by rotating from an initial position proximate the base to an upright position over the first side, wherein the first canopy support arm and the second canopy support arm are further configured to support the canopy and form a second chamber by rotating from an initial position proximate the base to an orthogonal position over the second side, wherein, in response to the rotating from an initial position proximate the base to the orthogonal position, a first return force is generated to return the first canopy support arm to the initial position and a second return force is generated to return the second canopy support arm to the initial position, wherein the first canopy support arm comprises a first tip and the second canopy support arm comprises a second tip, wherein the first canopy support arm configured to couple to the second canopy support arm forming an arched structure over at least one of the first side or the second side, wherein the first tip overlaps the second tip, wherein the first return force opposes the second return force.

2. The life raft of claim 1, wherein the joint comprises a base end and a support arm end.

3. The life raft of claim 2, wherein the joint comprises at least one of opposed frustoconical portions, an excess material, or a strap.

4. The life raft of claim 2, wherein the base comprises a first border tube circumscribing the first side of the base and a second border tube circumscribing the second side of the base.

5. The life raft of claim 4, wherein the canopy is coupled to at least one of the first canopy support arm or the second canopy support arm.

6. The life raft of claim 1, wherein the joint comprises opposed frustoconical portions including a first tapered portion having a first diameter, a second tapered portion having the first diameter, and an interface between the first tapered portion and the second tapered portion having a second diameter, wherein the second diameter is about ¾ of the first diameter.

7. The life raft of claim 1, wherein the canopy is configured to extend across the arched structure and the first side of the base to form the first chamber, wherein the arched structure extends over the first side, wherein the first chamber is defined between the first side of the base and the canopy.

8. The life raft of claim 7, wherein the canopy is further configured to extend across the arched structure and the second side of the base to form the second chamber, wherein the arched structure extends over the second side, wherein the second chamber is defined between the second side of the base and the canopy.

9. The life raft of claim 8, wherein the life raft is reversible such that in response to the life raft being deployed with the second side obstructed and the arched structure extending over the first side, the first chamber functions as a passenger compartment; and in response to the life raft being deployed with the first side obstructed and the arched structure extending over the second side, the second chamber functions as the passenger compartment.

10. The life raft of claim 1, wherein the first return force is between 5 and 20 lbs, wherein the second return force is between 5 and 20 lbs, and wherein an opposition between the first return force and the second return force stabilizes the arched structure.

11. A life raft comprising:

a base comprising a first border tube and a second border tube, wherein the first border tube circumscribes a first side of the base and the second border tube circumscribes a second side of the base;

an arch structure extending over at least one of the first side of the base or the second side of the base; and a canopy coupled to the arch structure and configured to extend across the at least one of the first side of the base or the second side of the base, wherein the canopy configured to extend across the first side of the base forms a first chamber defined between the first side of the base, the arch structure extending over the first side of the base and the canopy, and wherein the canopy configured to extend across the second side of the base forms a second chamber defined between the second side of the base, the arch structure extending over the second side of the base and the canopy, wherein the arch structure comprises a first canopy support arm having a first tip and a second canopy support arm having a second tip, wherein the first canopy support arm is coupled to the second canopy support arm forming the arch structure, wherein the first tip overlaps the second tip and wherein an opposition between a first return force at the first tip and a second return force at the second tip stabilizes the arch structure.

12. The life raft of claim 11, wherein the arch structure comprises a joint configured to enable the first chamber or the second chamber to function as a passenger compartment depending upon the orientation of the life raft with respect to a body of water.

13. The life raft of claim 12, wherein the joint comprises opposed frustoconical portions including a first tapered portion having a first diameter, a second tapered portion having the first diameter, and an interface between the first tapered portion and the second tapered portion having a second diameter, wherein the second diameter is about ¾ of the first diameter.

14. A method of using a life raft comprising a reversible canopy system, the method comprising:

inflating the life raft;

inflating a first canopy support arm and a second canopy support arm in response to inflating the life raft;

rotating the first canopy support arm and the second canopy support arm relatively orthogonal with respect to a base of the life raft and;

in response to the rotating the first canopy support arm and the second canopy support arm relatively orthogonal with respect to the base of the life raft, generating a first return force and a second return force;

coupling the first canopy support arm and the second canopy support arm and, in response, forming an arched structure over a side of the base of the life raft disposed above an obstruction wherein a tip of the first canopy support arm overlaps a tip of the second canopy support arm, wherein the first return force and the second return force are in opposition; and configuring a chamber defined between a canopy over the arched structure and the side of the base of the life raft disposed above the obstruction to function as a passenger compartment.

15. The method of claim 14, further comprising at least partially opening the passenger compartment for passengers to embark.

16. The method of claim 14, further comprising positioning the first canopy support arm and the second canopy support arm are proximate the base in response to inflating the life raft.

* * * * *